US005795466A

United States Patent [19]

Kelebek et al.

[11] Patent Number: 5,795,466

[45] Date of Patent: Aug. 18, 1998

[54] PROCESS FOR IMPROVED SEPARATION OF SULPHIDE MINERALS OR MIDDLINGS ASSOCIATED WITH PYRRHOTITE

[75] Inventors: Sadan Kelebek, Kingston; Peter F. Wells, Sudbury; Simon O. Fekete, Oakville; Michael J. Burrows, Lively, all of Canada; Daniel F. Suarez, Bonao, Dominican Rep.

[73] Assignee: Falconbridge Limited, Toronto, Canada

[21] Appl. No.: 863,367

[22] Filed: May 27, 1997

[51] Int. Cl.[6] ..... B03D 1/06

[52] U.S. Cl. ..... 209/166; 209/167; 209/1; 241/24.12; 241/24.25

[58] Field of Search ..... 209/166, 167, 209/1, 901; 241/24.12, 24.25

[56] References Cited

U.S. PATENT DOCUMENTS

| | | |
|---|---|---|
| 1,290,166 | 1/1919 | Gahl . |
| 3,655,044 | 4/1972 | Delany . |
| 3,883,421 | 5/1975 | Cutting et al. . |
| 4,585,549 | 4/1986 | Malghan . |

FOREIGN PATENT DOCUMENTS

| | | |
|---|---|---|
| 593065 | 3/1987 | Australia . |
| 1156380 | 1/1983 | Canada . |
| WO 93/04783 | 3/1993 | WIPO . |

OTHER PUBLICATIONS

S. Chander and D.W. Fuerstenau, "Electrochemical Flotation Separation of Chalcocite From Molybdenite", International Journal of Mineral Processing, 1983, pp. 89–94, vol. 10, Elsevier Scientific Publishing Company, Amsterdam.

Wang Qun and K. Heiskanen, "Separation of pentlandite and Nickel Arsenide Minerals by Aeration Conditioning Flotation", International Journal of Mineral Processing, 1990, pp. 99–109, vol. 29, Elsevier Science Publishers B.V., Amsterdam.

J.H. Ahn and J.E. Gebhardt, "Effect of Grinding Media–Chalcopyrite Interaction on the Self–Induced Flotation of Chalcopyrite", International Journal of Mineral Processing, 1991, pp. 243–262, vol. 33, Elsevier Science Publishers B.V., Amsterdam.

S. Kelebek, "The Effect of Oxidation on the Flotation Behaviour of Nickel–Copper Ores", XVIII International Mineral Processing Congress, 1993, pp. 999–1005.

*Primary Examiner*—Thomas M. Lithgow
*Attorney, Agent, or Firm*—George J. Primak

[57] ABSTRACT

A multi-stage froth flotation process is provided for concentrating sulphide minerals or middlings containing non-ferrous metal values such as nickel, cobalt and copper, which co-exist with significant amounts of pyrrhotite. The process is carried out without relying on any specific reagent as pyrrhotite depressant, but rather by exploiting the natural pulp environment with low REDOX potentials generated by mild steel grinding media in the grinding step preceding the froth flotation. The concentrate from the flotation stage(s) in which the REDOX potential rises above a predetermined value, is recycled back to the grinding step and/or to preceding flotation stage(s) from which concentrate is collected as the final product or is subjected to an up-grading in a further cleaning stage.

25 Claims, 2 Drawing Sheets

PROCESS FOR IMPROVED SEPARATION OF SULPHIDE MINERALS OR MIDDLINGS ASSOCIATED WITH PYRRHOTITE

FIELD OF THE INVENTION

This invention relates to a flotation process for removing pyrrhotite from a mixture of other minerals containing commercial metal values which include base metals such as nickel, copper, cobalt, zinc, lead as well as associated precious metals such as platinum, palladium and gold. More particularly, the invention relates to an improved process for concentrating sulphide minerals or middlings containing non-ferrous metal values in association with pyrrhotite without relying, particularly in the basic flotation circuit, on the use of a specific reagent as pyrrhotite depressant. As used herein "middlings" refer to pre-processed streams of the ore of at least one mono- or multi-metal sulphide mineral containing non-ferrous metal(s) co-existing with pyrrhotite.

BACKGROUND OF THE INVENTION

Mineral dressing involves separation processes that make use of exploitable differences in the properties of minerals. When the raw ore contains mineral constituents that are appreciably different in terms of their specific gravities, gravity separation methods are primarily applied for their concentration. Many sulphide deposits contain pyrrhotite which, having little or no commercial value, may be regarded as a sulphide gangue. Monoclinic form of this mineral is magnetic; therefore, this mineral is amenable to magnetic separation and many plants processing pyrrhotite containing ores have magnetic separators as an integral part of their operations. Mineral separation in some cases may require a fine particle size for efficient liberation and process selectivity and thus some differences can be artificially generated in the surface properties of the mineral particles. In such cases, the method of separation is based on the exploitation of the hydrophobicity differences between particles of the various minerals within the froth flotation process, which is within the field of the present invention.

Complex sulphide ores, such as those found in the area of Sudbury, Canada, comprise pentlandite (3–5%), chalcopyrite (2.5–3.5%), nickeliferous pyrrhotite (20–30%) and pyrite along with some other sulphides in small and variable amounts. Non-sulphide gangue minerals consist of mainly quartz and feldspar and minor quantities of tremolite, biotite, magnetite and talc. Pyrrhotite which represents about 80% of the sulphides in the ore, is associated with other minerals, primarily with pentlandite. In the treatment of such complex ores, some process streams produced may consist essentially of all pentlandite-pyrrhotite middlings. Efficiency of minerals separation in such cases is poor and does not often meet metallurgical objectives. Poor separations result in low concentrate grades of valuable minerals. In the processing of nickel-copper ores in the Sudbury region, a selective separation process will improve the concentrate grades while allowing an economical rejection of the least valuable sulphide component, pyrrhotite, which is the main contributor to sulphur dioxide emissions from smelters.

In general, the flotation process involves the grinding of the crushed ore in a dense slurry to the liberation size of associated minerals, followed by conditioning with reagents in a suitably dilute slurry. Broadly, reagents may function as collectors which increase the surface hydrophobicity (aerophilicity) of minerals, frothers which generate stable bubbles of suitable sizes in the slurry for the capture and transfer of particles to the froth phase for their removal as concentrate, or depressants which, contrary to the collector action, increase the surface hydrophilicity of selected mineral particles for their rejection through tails.

Implementation of chemicals for industrial applications is a complex process. It often involves difficult decisions related to cost and benefits and more importantly, their impact on the environment, both the working environment in the plant and on local ecology. Indeed, the cost and the negative impact of some specific reagents on the environment are a matter of serious concern. There is always a need for less costly and more environment-friendly reagents for more economical and cleaner mineral processing applications. It is usually advantageous to minimize or, if possible, to eliminate the dependence on a specific reagent, hence, allowing a minimum or zero residual discharge level to the environment.

It is known that some sulphide minerals can establish hydrophobicity and hence floatability at much lower pulp (REDOX) potentials than others. For example, S. Chander and D. W. Fuersteneau (Int. J. Miner. Process., Vol. 10, pp. 89–94, 1983) showed, in small scale tests, that the molybdenite-chalcocite separation may be achieved by control of the electrochemical (REDOX) potential. Chalcocite flotation was inhibited at reducing potentials, thus allowing selective flotation of molybdenite. At oxidizing potentials, chalcocite floated in preference to molybdenite.

The oxidation/reduction effects have also been exploited for the separation of other sulphide minerals. For example, W. Qun and K. Heiskanen (Int. J. Miner. Process., Vol. 29, pp. 99–109, 1990) have shown that pentlandite will float in preference to nickel arsenide and S. Kelebek (XVIII Int. Miner. Process. Congress, pp. 999–1005, 1993) has shown that it will float in preference to pyrrhotite. The flotation separation of pentlandite in these two cases has been explained by selective oxidation of the associated minerals, nickel arsenide and pyrrhotite, respectively, which are more susceptible to oxidation due to their electrochemical nature.

It has been found that exploitable surface electrochemical differences which naturally exist among sulphide minerals at reducing potentials usually diminish at oxidizing potentials. Therefore, preservation of reducing potentials by application of inert gases also offers some advantages in mineral separation processes. For example, nitrogen may be used to control the REDOX potential to achieve a more effective depressant action of a Nokes-type reagent on copper sulphide ore in its separation from molybdenite; U.S. Pat. No. 3,655,044 discloses such a process. The separation of molybdenite-chalcopyrite ores has also been shown to take place by REDOX potential control using nitrogen gas alone, without involvement of any specific reagent such as sodium sulphide (J. H. Ahn and G. E. Gebhartd, Int. J. Miner. Process., Vol. 33, pp. 243–262, 1991).

The use of low REDOX potential has also been shown to be beneficial in the flotation of nickel-copper ores. For example, in Canadian Patent No. 1,156,380, REDOX potential is adjusted to −330 mV (SCE) before pentlandite is selectively floated with xanthate in the presence of pyrrhotite. However, this method uses relatively high dosages of cyanide which may have an adverse effect on the precious metal recoveries while, at the same time, presenting some environmental problems.

Australian Patent No. 593,065 advocates the use of nitrogen or other inert gases as a protective atmosphere against oxidation of sulphide minerals during the crushing operation. Then, during the subsequent flotation, REDOX potential is maintained at a value of less than −200 mV and greater than −500 mV by the injection of nitrogen and/or oxidizing gas to achieve improved selectivity between minerals.

Separation of sulphide minerals, in some cases, does not necessitate a protective atmosphere during grinding as an essential step for selective flotation. In the PCT international patent application WO 93/04783 published Mar. 18, 1993, the sulphide ore containing pentlandite, pyrrhotite and possibly talc is ground under substantially non-reducing conditions to promote oxidation and then subjected to a talc pre-float. The tailing enriched in sulphides is split-conditioned and then subjected to flotation to selectively recover pentlandite in the absence of copper sulphate.

From U.S. Pat. No. 3,883,421 it is also generally known to measure the REDOX potential during the beneficiation of an ore slurry and then maintaining this potential within a predetermined range by addition of a suitable chemical substance such as sodium sulphide, to improve the separation of mineral values from the slurry.

U.S. Pat. No. 4,585,549 also provides a process for recovering copper minerals by flotation while maintaining a REDOX potential below −100 mV (SCE) through addition of a surface modifying agent, such as sodium sulphide.

None of the above prior art methods has provided a system or a process where the beneficial effect of low REDOX potentials can be exploited without relying on some chemical substance to maintain the REDOX potential within a predetermined range or using an inert gas during crushing or flotation operation or some special pre-float or split-conditioning operations or the like.

SUMMARY OF THE INVENTION

The present invention provides a process for selective flotation of sulphide minerals or middlings containing non-ferrous metal values such as nickel, cobalt and copper, together with associated precious metals, from pyrrhotite, using a plurality of stages of froth flotation where a predetermined low REDOX potential is maintained in some of the stages and employed for the purposes of the present invention. The novel process does not rely on addition of a specific reagent for selectivity in flotation or for maintaining the REDOX potential at a predetermined value and does not resort to the use of an inert gas or some specific pre-float or split-conditioning operations. Of course, use of some flotation reagents such as a frother, a collector and a pH regulator are within the ambit of the present invention, however no specific depressant for pyrrhotite or gangue needs to be employed within the basic froth flotation process.

In many sulphide mineral processing operations, process middlings are directed into a single stream for regrinding to liberate the minerals involved. This is followed by their separation into various products using selective flotation. Grinding media used in such fine grinding applications include steel balls, commonly made of mild steel. The surface properties of minerals are strongly influenced by the repeated contact with such media as well as associated smearing and polishing action taking place during grinding. An important aspect thereof is the generation of low REDOX potentials due mainly to reactions involved in the corrosion of the metallic iron from the media which acts as a kind of surface active agent in the electrochemistry of sulphide flotation.

It is therefore an object of the present invention to exploit the low REDOX potentials resulting from the grinding operation to achieve a more selective mineral separation in a subsequent flotation stage.

Another object is to improve the recoverability of some associated minerals containing precious metals, which are sensitive towards superficial oxidation during processing and have relatively low recoveries due to adverse effect of oxidation on their floatability.

A still further object of the present invention is to provide for treatment of the process middlings while maintaining a link between the chemistry of grinding environment and the flotation process which acts as a natural depressant for pyrrhotite, thereby suppressing its floatability and allowing selective recovery of associated valuable minerals.

Other objects and advantages of this invention will become apparent from the further description thereof.

Thus, the process of the present invention for concentrating sulphide minerals or middlings containing non-ferrous metal values in association with pyrrhotite, essentially comprises:

(a) grinding the sulphide minerals or middlings at a pH above 9.5 into a fine pulp by means of grinding media such as to produce a low REDOX potential in the resulting pulp of less than a predetermined value selected within a range of −150 to −250 mV (SCE);

(b) subjecting said pulp having the REDOX potential of less than said predetermined value to a plurality of stages of froth flotation, preferably with air sparging, in the presence of a collector and a frother, but essentially in the absence of a specific pyrrhotite depressive reagent, whereby a concentrate is produced in each of the stages of the froth flotation during which the REDOX potential rises above the predetermined value in some stage or stages of said flotation;

(c) recycling a scavenger concentrate from the stage or stages where the REDOX potential has risen above the predetermined value back to the grinding step (a) and/or to a stage or stages where the REDOX potential is less than the predetermined value; and (d) collecting the concentrate from the stage or stages in which the REDOX potential is less than the predetermined value as a final concentrate or subjecting the same to a further cleaning stage.

The novel process is especially useful for the separation of finely disseminated sulphide minerals within pyrrhotite which require fine grinding, usually employing steel grinding media. Grinding of pyrrhotite containing ore or pre-processed middlings is normally carried out in the presence of air in an alkaline pulp, preferably, at a pH range of 9.5–11.5. Lime is preferred as the pH regulator. Excessive pulp aeration in the grinding mill, the classification system and slurry transportation lines is preferably avoided. Flotation is preferably performed on a cyclone overflow from a grinding operation without having been subjected to a pre-aeration or pre-flotation stage. The recycle of some concentrate back to the preceding flotation stages, preferably after going through the grinding circuit, functions as a means of upgrading the feed, while ensuring the avoidance of down-grading the concentrate. From an electrochemical point of view, the recycle also ensures that the flotation is carried out in the REDOX potential range below the predetermined value; hence in a more selective environment. This predetermined value is usually below −150 mV to −250 mV (SCE) range and preferably in the range of −250 mV to −450 mV (SCE). Xanthate is normally used as the collector and is added in an amount that is sufficient to effectively support the flotation of desirable minerals, but insufficient to trigger the flotation of an undesirable amount of pyrrhotite. Propyl, butyl or amyl xanthate are preferred collectors. Generally a starvation amount of xanthate will be used, not an excess amount. In the treatment of process middlings, neither xanthate nor frother addition may be needed due to the presence of residual reagents in the pulp from previous process stages. Grind size is dictated by liberation characteristics of the feed. For secondary circuit streams, especially for the treatment of middling streams, it can be as fine as 75 to 95% passing 325 mesh screen (i.e., 44 μm or micrometers). Preferably, the pulp should be in excess of 85% finer than 44 μm.

The grinding process may be carried out using conventional ball milling, or other types such as stirring mills and agitated mills with or without in-situ flotation capability. These latter types may be suitable for their finer grinding capacity and lesser power consumption. The grinding media may consist of relatively reactive steel of suitable shape and size or a mixture that includes iron in substantial amounts to provide a suitable low REDOX potential of the pulp. It is considered that the amount of grinding is dictated not only by the liberation requirements of the feed, but also by REDOX requirements. This is a fundamental aspect of the present invention.

The flotation process may be carried out using conventional mechanical cells or, for selected applications, other type of cells such as columns and Jameson cells which have been reported to have some advantages. Any frother suitable for sulphide flotation can be used. One example of such frother is known under the trade name DOWFROTH-250, but it is by no means limitative.

The process of the present invention is particularly suitable for treating plant streams that have the maximum amount of Po (pyrrhotite) which are particularly difficult to treat by known methods. For example, when a combination of Pn (pentlandite) and Po (pyrrhotite) is treated in accordance with the present invention, best results are obtained when Po/Pn ratio is as high as possible, e.g. Po/Pn should be greater than 15 and preferably greater than 40.

BRIEF DESCRIPTION OF THE DRAWINGS

Some preferred embodiments of the invention will now be described with reference to the appended drawings, in which.

DETAILED DESCRIPTION OF THE INVENTION

Figure 1:
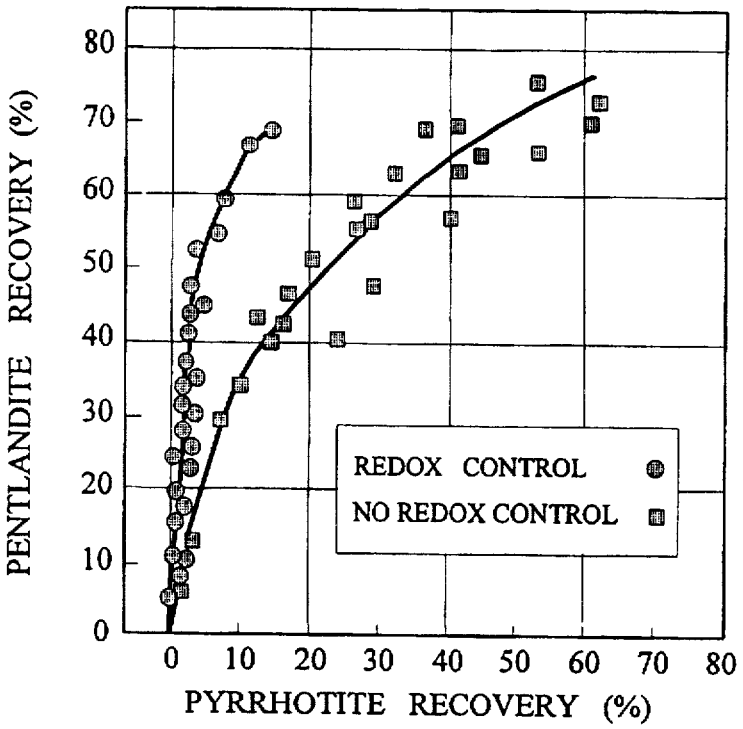
FIG. 1 is a graph showing the influence of REDOX potential control on Po-Pn flotation selectivity.

Referring to FIG. 1, it illustrates the selectivity of pentlandite against pyrrhotite recovery achieved by controlling the REDOX potentials at relatively low levels (for example, −300 to −340 mV (SCE) at initial stages and −250 mV (SCE) at subsequent stages). The samples employed in the demonstration of this flotation behaviour were taken from process streams consisting mainly of pyrrhotite-pentlandite middlings processed in a nickel-copper processing plant in the Sudbury region. This demonstrates that the REDOX-dependent flotation characteristics may be exploited for the separation of sulphide minerals such as pentlandite, which are associated with pyrrhotite.

It is generally known in the art that the use of certain grinding media, such as mild steel media, will cause low REDOX potentials in the resulting pulp, particularly if it is ground to a fine size, which is normally required for separation of sulphide ore and particularly of middlings, from pyrrhotite. Thus, while fine grinding with such media enhances the degree of mineral liberation, it also provides the particles with low REDOX potentials due to numerous media-particle impacts and prolonged contacts with associated smearing action in the grinding mill which is the reservoir of the lowest REDOX potentials in mineral processing plants. REDOX potential readings in a regrinding mill discharge of a mineral processing plant in the Sudbury region are usually in the range −400 mV to −450 mV (SCE). When the dissolved oxygen is expelled from the pulp the potentials usually reach much lower levels. The present invention relies on maximum exploitation of the low REDOX potentials originating from the grinding operation as well as increased liberation of minerals from middlings without requiring the injection of an inert gas or addition of special chemical reagents.

From chemical equilibria simulations, for example, of grinding mill environment during grinding of a pyrrhotite-rich middling stream with mild steel media, it is observed that pyrrhotite is not oxidized in the presence of metallic iron, i.e. iron originating from the mild steel media. Also at the low potentials generated in the mill, most sulphide minerals will be protected from oxidation by preferential oxidation of mild steel media itself. It is also notable that xanthate is not oxidized nor does it react with pyrrhotite at such low potentials. These conditions will force pyrrhotite to remain in a relatively inactive state with an oxygenation or oxidation level that is insufficient for rapid hydrophobicity development. As long as the grinding media effect is dominant on its surface, pyrrhotite will not respond to flotation. However, under comparable pulp conditions, another sulphide mineral such pentlandite, will develop sufficient hydrophobicity since it will tend to generate appreciable amounts of active sites on its surface for collector action within the same time period as is available to pyrrhotite.

In a plant operating in the Sudbury region, high pentlandite-pyrrhotite selectivity is seen in early stages of flotation (i.e., primary rougher stage) where pyrrhotite recoveries lower than 10% are typical while the corresponding recoveries of pentlandite and chalcopyrite range from 60 to 70% and 70 to 80%, respectively. The characteristic feature of these initial flotation stages is high population of liberated particles in pulp as well as the grinding media effect and the low REDOX potentials. As the pulp is more and more oxygenated/oxidized during flotation in subsequent stages, the REDOX potentials rise and pyrrhotite, because its surface is transformed from an inactive state to an active state, floats faster causing a loss in selectivity. However, when the REDOX potential is not permitted to rise, or is maintained below a predetermined value, high flotation selectivity can be maintained as shown in FIG. 1. Such flotation behaviour of pyrrhotite is significantly dependent on the REDOX potential and grinding media effect. Therefore, generation and maintenance of low REDOX potentials have been seen as an essential step towards improving flotation selectivity.

One of the main features which the present invention relies on is the function of the grinding mill not only as a liberator of minerals from one another, but also as a unique source of sufficiently low REDOX potentials due chiefly to metallic iron from grinding media.

Another factor is related to the function of air not only as a source of bubble generation for the transport of desirable minerals into the froth phase in the flotation process, but also as oxidant in flotation chemistry of sulphides. The present invention limits the latter function of air which, as discussed hereinbefore, is a cause of premature loss of selectivity in flotation circuits. By not using excess air, the flotation selectivity between minerals to be separated is maximized.

Figure 2:
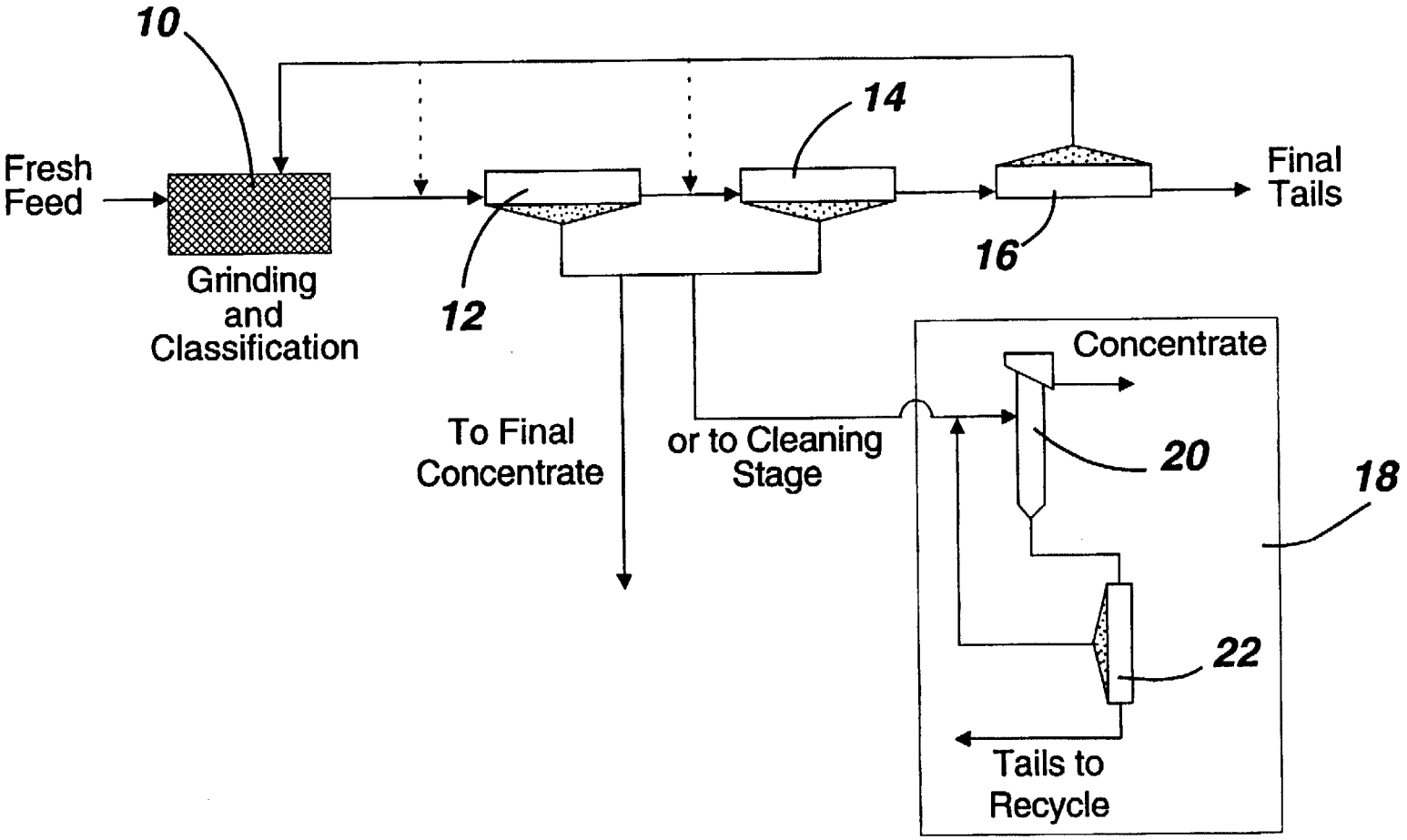
FIG. 2 illustrates a flowsheet depicting the essential aspects of the process of the present invention.

Referring to FIG. 2, the fresh feed which may contain, for example the pyrrhotite-rich sulphide ore or middlings from a minerals processing plant, is fed into grinding circuit 10 which also includes classification as part thereof. Grinding is carried out in this circuit 10 under normal conditions using steel grinding media, preferably mild steel grinding balls or slugs or the like, in the usual presence of air, to produce a pulp which reports to a first flotation stage 12. The grinding/classification is normally accomplished in such a way as to produce sufficiently fine particles so that the pulp will have the lowest REDOX potential possible. Depending on the composition of the ore, particularly the pyrrhotite content, the pulp potential may be in a range −300 to −450 mV (SCE). The pulp enters the flotation unit 12, preferably without much change in its REDOX potential range after leaving the grinding circuit 10. This potential range is sufficiently high to enable the flotation of desirable mineral (s), but low enough to keep pyrrhotite in its inactive state and non-floatable form. Flotation is carried out under moderately gentle conditions to pull a weight recovery which is typical of desirable selectivity on the basis of bench or pilot scale tests. The REDOX potential rises during this selective flotation to a range of lesser—but still acceptable—flotation selectivity, in the range of −250 to −150 mV at flotation stage 14. This potential range is an example of the highest range of the selected predetermined REDOX value which should not be exceeded in accordance with the present invention for collection of the concentrate either as a final product or for forwarding to a further cleaning stage 18.

A further flotation stage 16, which leads to the final tails, has a REDOX potential above the predetermined value or range selected at stage 14 and, therefore, the concentrate produced at this stage 16 is recycled to the grinding stage 10 or to flotation stages 13 or 14 or to a combination of these depending on the overall process requirements. In most cases, however, the concentrate from stage 16 will be recycled to the grinding and classification stage 10 where it is admixed with the fresh feed and re-ground. The recycle to the grinding circuit 10 may, for example, be carried out fractionally through the cyclone underflow or as an entire stream directly into the mill. The recycled concentrate may be reground in an open circuit arrangement in a single pass or in a closed circuit arrangement, with a classification unit, in a cyclical pass. It should be noted that at stage 16 (and there may be some further such stages in the overall system) flotation is continued with progressively less selectivity and, therefore, the weight fraction of the concentrate obtained at this stage must be recycled and refloated as mentioned above.

Thus, an important aspect of the present invention is to provide a recycling system as a tool for retention and selection control in the process. One function of this recycle is to expose the relatively oxidized and activated pulp to low REDOX potentials and preferably to residual grinding media or its prolonged effect to deactivate the pyrrhotite portion of the recycle. The grade of this recycle is preferably greater than the grade of the new feed entering the grinding unit. However, it is, in general, too low to allow it to be included in the final concentrate product. If such a stream is not recycled it will lower the concentrate grade to an unacceptable level in the overall flotation circuit because of its pyrrhotite-rich fraction which has been activated and floated within corresponding retention time. Thus, the recycle provides a "retention control" which improves the process efficiency. Another function of this recycle is to promote a "sharper selection" of the desirable minerals on the basis of a competition set-up among particles having a hydrophobicity distribution according to inherent surface chemistry, state of activation, exposure to grinding media effect and local oxidizing conditions. For example, highly floatable particles will compete with deactivated or less activated particles for the surface area of the same number of air bubbles which will "select" the former type. Thus, relatively weakly hydrophobic particles will not be captured by the bubbles and will eventually be rejected through the tails. The particles that are thus eliminated from the concentrate consist of pyrrhotite or pyrrhotite-rich composites as well as of non-sulphide gangue. The recycle provides, primarily for pyrrhotite, a link between the chemistry of the low REDOX potential grinding mill environment which is deactivating and that of the oxidizing (activating) stages of flotation environment. It is believed that, due to this link, the grinding media effect on pyrrhotite will gradually be more and more dominant, contributing significantly to its surface coating with stable iron hydroxide layers which will not respond to bubble contact any longer, thus making flotation conditions more favourable for its rejection through the tails.

FIG. 2, also shows an optional extension of the processing concept of the present invention to a cleaning stage 18 which may involve the use of a column 20 or the Jameson cell instead of conventional mechanical cells arranged in several stages. The cleaning may be performed with or without a conditioning stage and will usually include mechanical cell scavengers 22 treating the cleaner tails. In the cleaning stage 18, utilization of specific reagents may be useful to obtain the most efficient rejection of pyrrhotite from the final concentrate. However, since such specific reagents will be used only on a fraction of the total feed, namely only in the purification stage 18, the amount needed will be quite small compared to conventional flotation systems. Thus, another advantageous feature of the present invention is to minimize the reagent cost associated with the concentrate upgrading in the cleaning stage.

The following non-limitative examples will further illustrate the present invention and its advantages.

EXAMPLE 1

In this example, the influence of a second stage concentrate recycle through the regrinding circuit of a pilot plant is examined. The pilot plant testing facility with a 300 Kg/hr capacity was located in a Ni-Cu ore processing plant in the Sudbury region. Thus, it was possible to test various plant streams with different pyrrhotite levels. The feed used in this example was the magnetics fraction of the secondary rougher and scavenger concentrate with a Po/Pn ratio of about 40. It was ground to 97.6% finer than 44 micrometers. Flotation was carried out using a bank of two cells as the first stage and a bank of four cells as the second stage, arranged in series. No collector was used in the pilot plant because sodium isobutyl xanthate was already present in sufficient amount in the original plant feed. For the same reason, the amount of frother (DOWFROTH™250) used was limited to 10 g/tonne.

The recycle stream in this case was introduced into the pump box of the pilot grinding mill which received the fresh feed as well as the mill discharge and fed the hydrocyclone. The hydrocyclone overflow was sent to the bank of two cells with or without a conditioning period. The concentrate from the bank of two cells was accepted as the final concentrate. Another test was carried out using conditions similar to those in the previous test with the exception of the recycling through the grinding circuit. In this case, the concentrates from the first and second flotation stages were combined and represented the final concentrate. The results obtained are illustrated in the following Table 1 and Table 2, respectively. Note that in all tables, Ni (NiBS) represents nickel content in the nickel-bearing sulphides (Pn and Po). In all calculations, it was assumed that the average nickel content of pyrrhotite was 0.64%.

As the flotation proceeds, the pulp is progressively oxidized as indicated by the potentials becoming less negative and flotation selectivity between Pn and Po is lost. It should be noted that in the case of this invention (refer to data in Table 1), the final concentrate is obtained from the first bank which is characterized by significantly lower REDOX potentials (−150 mV to −250 mV). Thus, from an electrochemical point of view, the recycle feature of the present invention ensures that the flotation yielding the concentrate is carried out in a lower potential range, hence, in a more selective environment.

TABLE 1

(Recycle into pump box of pilot grinding mill), particle size: 97.6% <44 μm, Frother: 10 g/t, No new addition of Xanthate

| Flotation | Weight | Assays (%) | | | | | | Recovry (%) | | | | Po/Pn | Ni as |
|---|---|---|---|---|---|---|---|---|---|---|---|---|---|
| Product | (Kg/h) | Ni | Cu | S | Pn | Cp | Po | Ni | Pn | Cp | Po | Ratio | NiBS |
| FRESH FEED | 200.00 | 1.21 | 0.22 | 31.71 | 1.97 | 0.65 | 77.45 | 100.0 | 100.0 | 100.0 | 100.0 | 39.23 | 1.52 |
| 1st Bank FEED | 237.45 | 1.36 | 0.25 | 31.98 | 2.38 | 0.73 | 77.73 | 100.0 | 100.0 | 100.0 | 100.0 | 32.63 | 1.70 |
| 1st Bank CON | 24.73 | 4.83 | 1.53 | 33.55 | 12.08 | 4.45 | 70.34 | 37.0 | 52.8 | 63.7 | 9.4 | 5.82 | 5.86 |
| 1st Bank TAIL | 212.72 | 0.97 | 0.10 | 31.80 | 1.29 | 0.29 | 78.56 | 63.0 | 47.2 | 36.3 | 90.6 | 60.91 | 1.21 |
| 2nd Bank FEED | 212.72 | 0.97 | 0.10 | 31.80 | 1.29 | 0.29 | 78.56 | 100.0 | 100.0 | 100.0 | 100.0 | 60.91 | 1.21 |
| Recycle CONC | 37.45 | 2.16 | 0.39 | 33.43 | 4.56 | 1.13 | 79.20 | 39.2 | 62.3 | 67.5 | 17.7 | 17.36 | 2.58 |
| 2nd Bank TAIL | 175.27 | 0.71 | 0.04 | 31.45 | 0.59 | 0.12 | 78.42 | 60.8 | 37.7 | 32.5 | 82.3 | 133.28 | 0.90 |
| FINAL CONC | 24.73 | 4.83 | 1.53 | 33.55 | 12.08 | 4.45 | 70.34 | 48.8 | 74.3 | 84.4 | 11.2 | 5.82 | 5.86 |
| FINAL TAILS | 175.27 | 0.71 | 0.04 | 31.45 | 0.59 | 0.12 | 78.42 | 51.2 | 25.7 | 15.6 | 88.8 | 133.28 | 0.90 |

TABLE 2

(No recycle), particle size: 97.3% <44 μm, Frother: 10 g/t, No new addition of Xanthate

| Flotation | Weight | Assays (%) | | | | | | Recovry (%) | | | | Po/Pn | Ni as |
|---|---|---|---|---|---|---|---|---|---|---|---|---|---|
| Product | (Kg/h) | Ni | Cu | S | Pn | Cp | Po | Ni | Pn | Cp | Po | Ratio | NiBS |
| FLOT. FEED | 200.00 | 1.20 | 0.17 | 32.24 | 1.93 | 0.50 | 78.94 | 100.0 | 100.0 | 100.0 | 100.0 | 40.89 | 1.49 |
| 1st Bank CON | 23.65 | 3.84 | 1.05 | 34.21 | 9.26 | 3.04 | 75.59 | 37.7 | 56.8 | 71.2 | 11.3 | 8.16 | 4.53 |
| 2nd Bank CON | 27.90 | 1.54 | 0.20 | 34.21 | 2.79 | 0.57 | 83.14 | 17.9 | 20.2 | 15.7 | 14.7 | 29.75 | 1.80 |
| FINAL CONC | 51.55 | 2.60 | 0.59 | 34.21 | 5.76 | 1.70 | 79.68 | 55.6 | 77.0 | 86.9 | 26.0 | 13.83 | 3.04 |
| FINAL TAILS | 148.45 | 0.72 | 0.03 | 31.60 | 0.60 | 0.09 | 78.81 | 44.4 | 23.0 | 13.1 | 74.0 | 131.72 | 0.91 |

The recovery of pyrrhotite, in each case, is significantly lower than that of pentlandite and chalcopyrite, regardless of recycle. However, the overall pyrrhotite recovery at comparable pentlandite and chalcopyrite recoveries is substantially different: 11.2% using the process with the recycle in accordance with the present invention compared to 26.0% without. This level of pyrrhotite rejection represents a major improvement in the grades of nickel (from 2.6% and 4.8%) and copper (from 0.6% to 1.5%) of the concentrate at comparable recoveries of pentlandite and chalcopyrite.

The pH and REDOX data obtained during this test will now be examined in order to outline additional features of the process of the present invention. A potential range for the pulp has been obtained using a platinum electrode and saturated calomel reference electrode (SCE) by gently stirring the fresh slurry sample in a beaker. The REDOX potential data reflect only a relative oxidation level of the pulp and should not be quantitatively viewed as an absolute property of the pulp system. REDOX potentials typical of these pilot tests are given in the following Table 3.

TABLE 3

| Pulp | pH | % Solids | $E_{pt}$ (mV, SCE) |
|---|---|---|---|
| Fresh Feed | 10.7–10.9 | 39–41 | −350/−400 |
| Flotation Feed | 10.4–10.5 | 27–30 | −300/−330 |
| 1st Bank Tail | 9.0–9.3 | — | −150/−250 |
| 2nd Bank Tail | 8.4–6.7 | — | −30/−90 |

The data given in Tables 1 and 2 demonstrate the effectiveness of the present invention in improving the separation of pyrrhotite from associated base metal sulphides on a pilot plant scale.

EXAMPLE 2

The invention was also tested on a commercial scale in the mineral processing plant mentioned hereinbefore. Typical results are examined in this example. The feed to the test circuit, as in the previous example, consists predominantly of monoclinic pyrrhotite and associated pentlandite and some chalcopyrite. Currently, this magnetics fraction is split into two streams and sent to two regrinding circuits which operate in closed circuit with hydrocyclones. Each flotation circuit has three banks of six commercial size cells arranged in series. Prior to the circuit change effected in accordance with this invention, the concentrate from each bank reported to the final concentrate. The results obtained are given in the following Table 4.

TABLE 4

(No recycle), particle size: 87.8% <44 μm, No new addition of Xanthate or Frother

| Flotation | Weight | Assay (%) | | | | | | Recovry (%) | | | | Po/Pn | Ni as |
|---|---|---|---|---|---|---|---|---|---|---|---|---|---|
| Product | (Kg/h) | Ni | Cu | S | Pn | Cp | Po | Ni | Pn | Cp | Po | Ratio | NiBS |
| FLOT. FEED | 50.00 | 1.12 | 0.20 | 32.75 | 1.68 | 0.58 | 80.64 | 100.0 | 100.0 | 100.0 | 100.0 | 47.70 | 1.37 |
| 1st Bank CON | 5.09 | 3.48 | 1.22 | 35.72 | 8.18 | 3.53 | 79.86 | 31.5 | 49.4 | 61.5 | 10.1 | 9.77 | 3.95 |
| 2nd Bank CON | 3.73 | 1.64 | 0.30 | 35.37 | 3.00 | 0.88 | 85.60 | 10.9 | 13.3 | 11.3 | 8.0 | 28.54 | 1.85 |
| 3rd Bank CON | 4.74 | 1.24 | 0.17 | 35.07 | 1.89 | 0.51 | 86.11 | 10.4 | 10.6 | 8.2 | 10.2 | 45.62 | 1.40 |
| FINAL CONC | 13.56 | 2.19 | 0.64 | 35.40 | 4.56 | 1.74 | 83.62 | 52.7 | 73.3 | 81.0 | 28.2 | 18.36 | 2.48 |
| FINAL TAILS | 36.44 | 0.73 | 0.05 | 31.76 | 0.62 | 0.15 | 79.16 | 47.3 | 26.7 | 19.0 | 71.8 | 128.30 | 0.92 |

As may be noted, the flotation behaviour on the plant scale is quite similar to that on the pilot scale which was examined in Table 2. Although the recovery of pyrrhotite is lower than that of pentlandite and chalcopyrite, its dilution effect on the final concentrate is unacceptably high leading to a concentrate grade of 2.19% Ni.

Another plant test was carried out according to the process disclosed in the present invention in which the concentrate from the 3rd bank of six cells was recycled back into a stock tank which also received the unground magnetics and fed the regrinding circuits. The regrind cyclone overflow to the flotation circuit thus included the recycle portion. The combined concentrate from the first and second banks constituted the final concentrate from the circuit. This is essentially as shown in FIG. 2 of the drawings, without the cleaning stage. The results from this test are summarized in the following Table 5.

TABLE 5

(Recycle), particle size: 87.0% <44 μm, No new addition of Xanthate or Frother

| Flotation | Weight | Assay (%) | | | | | | Recovry (%) | | | | Po/Pn | Ni as |
|---|---|---|---|---|---|---|---|---|---|---|---|---|---|
| Product | (T/hr) | Ni | Cu | S | Pn | Cp | Po | Ni | Pn | Cp | Po | Ratio | NiBS |
| FRESH FEED | 50.00 | 1.12 | 0.20 | 32.66 | 1.66 | 0.58 | 80.18 | 100.0 | 100.0 | 100.0 | 100.0 | 48.21 | 1.36 |
| 1st Bank FEED | 85.44 | 1.15 | 0.21 | 32.78 | 1.75 | 0.61 | 80.37 | 100.0 | 100.0 | 100.0 | 100.0 | 45.89 | 1.40 |
| CONC-Bnk 1 + 2 | 6.67 | 3.56 | 1.23 | 34.21 | 8.48 | 3.57 | 75.77 | 24.2 | 37.8 | 45.7 | 7.4 | 8.93 | 4.23 |
| 2nd Bank TAIL | 78.78 | 0.94 | 0.12 | 32.66 | 1.18 | 0.36 | 80.76 | 75.8 | 62.2 | 54.3 | 92.6 | 68.34 | 1.15 |
| 3rd Bank FEED | 78.78 | 0.94 | 0.12 | 32.66 | 1.18 | 0.36 | 80.76 | 100.0 | 100.0 | 100.0 | 100.0 | 68.34 | 1.15 |
| Recycle CONC | 35.44 | 1.20 | 0.23 | 32.94 | 1.88 | 0.65 | 80.62 | 56.9 | 71.4 | 82.2 | 44.9 | 42.99 | 1.45 |
| 3rd Bank TAIL | 43.34 | 0.74 | 0.04 | 32.43 | 0.61 | 0.12 | 80.86 | 43.1 | 28.6 | 17.8 | 55.1 | 131.70 | 0.91 |
| FINAL CONC | 6.67 | 3.56 | 1.23 | 34.21 | 8.48 | 3.57 | 75.77 | 42.5 | 68.0 | 82.5 | 12.6 | 8.93 | 4.23 |
| FINAL TAILS | 43.34 | 0.74 | 0.04 | 32.43 | 0.61 | 0.12 | 80.86 | 57.5 | 32.0 | 17.5 | 87.4 | 131.70 | 0.91 |

The grades of nickel (3.56%) and copper (1.23%) of the concentrate are substantially higher than those seen in Table 4. This improvement results from a significant reduction in the recovery of pyrrhotite from 28% to 12.6% at reasonably comparable pentlandite and chalcopyrite recoveries.

Additional pH and REDOX data are given below in Table 6 to further evaluate the relevant characteristics of the invention as applied for a plant scale demonstration.

TABLE 6

| Pulp | pH | % Solids | $E_{pt}$ (mV, SCE) |
|---|---|---|---|
| Regrind Mill Discharge | 11.1 | 67 | −400/−450 |
| Regrind Cyclone Underflow | 11.0 | 69 | −400/−430 |
| Regrind Cyclone Overflow | 10.9 | 40 | −375/−400 |
| 1st Cell (1st Bank) | 10.8 | — | −300/−375 |

TABLE 6-continued

| Pulp | pH | % Solids | $E_{pt}$ (mV, SCE) |
|---|---|---|---|
| Tail Box of 1st Bank | 10.2 | — | −270/−305 |
| Tail Box of 2nd Bank | 9.3 | — | −200/−250 |
| 3rd Bank Concentrate | 8.8 | — | −80/−95 |
| Tail Box of 3rd Bank | 8.6 | — | −90/−100 |

As seen from this table, the mill discharge has the lowest REDOX potential range. The potentials inside the mill are likely to be lower than shown above. As already observed in Table 3, a similar change in REDOX potentials may be seen with respect to retention time in flotation. It should be noted that the third bank concentrate is significantly oxidized as revealed by its high REDOX potential readings. This represents the recovery of an undesirable amount of pyrrhotite which must be recycled for deactivation.

The data given in this example also demonstrate the effectiveness of the present invention on a plant scale as applied to the process middlings such as the magnetics fraction of a scavenger concentrate.

EXAMPLE 3

As in the previous case, the results obtained in this example are based on a plant scale test. However, the feed used in these tests also includes the non-magnetics fraction. This stream has additional pyrrhotite in hexagonal form which does not normally report to the magnetics fraction. In addition, the non-magnetics fraction has a significant amount of non-sulphide gangue. The circuit flows involved in this test were the same as in the previous example. The first set of results are given below in Table 7. The feed has 1.29% nickel, 0.34% copper and only 25.2% sulphur having relatively high gangue content and low pyrrhotite/ pentlandite ratio. Pyrrhotite recovery to the concentrate is restricted to 12.9% providing a substantial amount of pyrrhotite rejection.

TABLE 7

(Recycle), particle size: 96.7% <44 μm, No new addition of Xanthate or Frother

| Flotation | Weight | Assay (%) | | | | | | Recovry (%) | | | | Po/Pn | Ni as |
|---|---|---|---|---|---|---|---|---|---|---|---|---|---|
| Product | (T/hr) | Ni | Cu | S | Pn | Cp | Po | Ni | Pn | Cp | Po | Ratio | NiBS |
| FRESH FEED | 47.08 | 1.29 | 0.34 | 25.2 | 2.50 | 0.97 | 60.29 | 100.0 | 100.0 | 100.0 | 100.0 | 24.09 | 2.06 |
| 1st Bank FEED | 50.00 | 1.34 | 0.34 | 25.4 | 2.61 | 1.00 | 60.70 | 100.0 | 100.0 | 100.0 | 100.0 | 23.24 | 2.11 |
| CONC-Bnk 1 + 2 | 6.27 | 5.52 | 2.26 | 30.3 | 14.20 | 6.56 | 58.46 | 51.9 | 68.2 | 82.3 | 12.1 | 4.12 | 7.50 |
| 2nd Bank TAIL | 43.73 | 0.73 | 0.07 | 24.7 | 0.95 | 0.20 | 61.02 | 48.1 | 31.8 | 17.7 | 87.9 | 64.34 | 1.18 |
| 3rd Bank FEED | 43.73 | 0.73 | 0.07 | 24.7 | 0.95 | 0.20 | 61.02 | 100.0 | 100 | 100 | 100 | 64.34 | 1.18 |
| Recycle CONC | 2.92 | 2.00 | 0.49 | 28.7 | 4.34 | 1.42 | 67.28 | 18.2 | 30.5 | 46.7 | 7.4 | 15.52 | 2.80 |
| 3rd Bank TAIL | 40.81 | 0.64 | 0.04 | 24.4 | 0.71 | 0.12 | 60.57 | 81.8 | 69.5 | 53.3 | 92.6 | 85.78 | 1.05 |
| FINAL CONC | 6.27 | 5.52 | 2.26 | 30.3 | 14.20 | 6.56 | 58.46 | 56.9 | 75.5 | 89.7 | 12.9 | 4.12 | 7.50 |
| FINAL TAILS | 40.81 | 0.64 | 0.04 | 24.4 | 0.71 | 0.12 | 60.57 | 43.1 | 24.5 | 10.3 | 87.1 | 85.78 | 1.05 |

The corresponding recoveries of pentlandite and chalcopyrite, respectively, are 75.5% and 89.7%, the former being lower than the latter because of an intimate association with pyrrhotite.

Table 8 given below provides additional results obtained using a new feed having a higher nickel grade, 1.44%. This feed has contained magnetics fractions and also the concentrate from the non-magnetics flotation circuit. The latter fraction is characterized by a relatively poor grade due to high recovery of pyrrhotite (typically above 50% unit recovery) and gangue. The treatment carried out according to the present invention improved the separation efficiency of pentlandite from pyrrhotite by limiting the recovery of the latter. The feed under consideration has an average particle size of 81.5% passing 44 μm mesh size, a grind size significantly coarser than the preceding sample. The recovery of pentlandite (79.9%) is higher and that of pyrrhotite (21.4%) lower than their respective levels seen in Table 2 (e.g., pyrrhotite, 26%) and Table 4 (e.g., pyrrhotite, 28.2%) despite relatively coarse grind size. However, the recovery of pyrrhotite is rather high compared to the case shown in Table 7 (12.9%).

An additional feature of the invention is provided by another plant test which was carried out using a more finely divided feed sample having also a higher nickel grade. The particle size (95% passing 44 μm mesh), pH (10.5) and feed characteristics (Po/Pn ratios 20–25) in this test were quite similar to those seen in Table 7. The results obtained according to present invention are summarized in the following Table 9 from which it may be noted that the nickel and copper grades of the final concentrate are significantly improved.

TABLE 8

(Recycle), particle size: 81.5% <44 μm, pH: 10.7, No new addition of Xanthate of frother

| Flotation | Weight | Assay (%) | | | | | | Recovry (%) | | | | Po/Pn | Ni as |
|---|---|---|---|---|---|---|---|---|---|---|---|---|---|
| Product | (T/hr) | Ni | Cu | S | Pn | Cp | Po | Ni | Pn | Cp | Po | Ratio | NiBS |
| Fresh Feed | 61.26 | 1.44 | 0.28 | 32.47 | 2.58 | 0.81 | 78.74 | 100.0 | 100.0 | 100.0 | 100.0 | 30.54 | 1.77 |
| 1st Bank FEED | 70.00 | 1.43 | 0.26 | 32.66 | 2.54 | 0.76 | 79.26 | 100.0 | 100.0 | 100.0 | 100.0 | 31.15 | 1.75 |
| CONC-Bnk 1 + 2 | 13.57 | 3.86 | 1.11 | 34.47 | 9.30 | 3.23 | 76.03 | 52.3 | 70.8 | 81.9 | 18.6 | 8.18 | 4.57 |
| 2nd Bank TAIL | 56.43 | 0.84 | 0.06 | 32.22 | 0.92 | 0.17 | 80.04 | 47.7 | 29.2 | 18.1 | 81.4 | 87.13 | 1.04 |
| 3rd Bank FEED | 56.43 | 0.84 | 0.06 | 32.22 | 0.92 | 0.17 | 80.04 | 100.0 | 100.0 | 100.0 | 100.0 | 87.13 | 1.04 |
| Recycle CON | 8.74 | 1.37 | 0.16 | 33.94 | 2.31 | 0.46 | 82.95 | 25.1 | 39.0 | 41.9 | 16.0 | 35.87 | 1.61 |
| 3rd Bank TAIL | 47.69 | 0.75 | 0.04 | 31.91 | 0.67 | 0.12 | 79.51 | 75.0 | 61.0 | 58.1 | 84.0 | 119.47 | 0.94 |
| FINAL CONC | 13.57 | 3.86 | 1.11 | 34.47 | 9.30 | 3.23 | 76.03 | 59.4 | 79.9 | 88.7 | 21.4 | 8.18 | 4.57 |
| FINAL TAILS | 47.69 | 0.75 | 0.04 | 31.91 | 0.67 | 0.12 | 79.51 | 40.6 | 20.1 | 11.3 | 78.6 | 119.47 | 0.94 |

TABLE 9

(Recycle), particle size: 95% <44 μm, pH: 10.5, No new addition of Xanthate of frother

| Flotation | Weight | Assay (%) | | | | | | Recovry (%) | | | | Po/Pn | Ni as |
|---|---|---|---|---|---|---|---|---|---|---|---|---|---|
| Product | (T/hr) | Ni | Cu | S | Pn | Cp | Po | Ni | Pn | Cp | Po | Ratio | NiBS |
| Fresh Feed | 44.78 | 1.52 | 0.48 | 26.98 | 3.07 | 1.40 | 64.00 | 100.0 | 100.0 | 100.0 | 100.0 | 20.83 | 2.27 |
| 1st Bank FEED | 50.01 | 1.52 | 0.46 | 27.58 | 3.05 | 1.34 | 65.59 | 100.0 | 100.0 | 100.0 | 100.0 | 21.54 | 2.22 |
| CONC-Bnk 1 + 2 | 7.67 | 5.75 | 2.63 | 32.80 | 14.74 | 7.63 | 63.45 | 57.9 | 74.3 | 87.5 | 14.8 | 4.30 | 7.12 |
| 2nd Bank TAIL | 42.33 | 0.76 | 0.07 | 26.63 | 0.92 | 0.20 | 65.98 | 42.1 | 25.7 | 12.5 | 85.2 | 71.33 | 1.13 |
| 3rd Bank FEED | 42.33 | 0.76 | 0.07 | 26.63 | 0.92 | 0.20 | 65.98 | 100.0 | 100.0 | 100.0 | 100.0 | 71.33 | 1.13 |
| Recycle CON | 5.22 | 1.53 | 0.27 | 32.72 | 2.81 | 0.79 | 79.18 | 24.9 | 37.5 | 49.5 | 14.8 | 28.15 | 1.86 |
| 3rd Bank TAIL | 37.11 | 0.65 | 0.04 | 25.78 | 0.66 | 0.11 | 64.12 | 75.1 | 62.5 | 50.5 | 85.2 | 97.21 | 1.00 |
| FINAL CONC | 7.67 | 5.75 | 2.63 | 32.80 | 14.74 | 7.63 | 63.45 | 64.7 | 82.2 | 93.3 | 17.0 | 4.30 | 7.12 |
| FINAL TAILS | 37.11 | 0.65 | 0.04 | 25.78 | 0.66 | 0.11 | 64.12 | 35.3 | 17.8 | 6.7 | 83.0 | 97.21 | 1.00 |

The recovery of pyrrhotite is now much lower than that indicated in the preceding test which had relatively coarse feed. Thus, an important aspect of the process of the present invention is the selective flotation of finely divided feed in a low REDOX potential range.

The metallurgical data examined in this example demonstrates the effectiveness of the invention on the commercial scale as it is applied to the process middlings found both in the magnetics and non-magnetics fractions of the plant streams.

EXAMPLE 4

As pyrrhotite constitutes a major portion of the Pn-Po separation feed, its efficient rejection through the tails means a significant reduction in the weight recovery of the concentrates produced. In this example, the effect this may have on the recovery of precious metals is addressed. The impact of the invention on the precious metal recoveries is examined in Tables 10–14 given below. The data in Table 10 and Table 11 are from the two pilot tests which were considered in Example 1.

Similarly, the precious metal data in Table 12 and Table 13 are from two plant tests which were already evaluated in Example 2 for the flotation behaviours of the base metal sulphides. The former summarizes the data obtained without any recycle. The latter, on the other hand, represents the data obtained with the recycling system according to the present invention.

TABLE 10

(Recycle according to the current invention, pilot data)

| Flotation | Weight | Weight | Assay (g/T) | | | Recovery (%) | | |
|---|---|---|---|---|---|---|---|---|
| Product | (Kg/h) | (%) | Pt | Pd | Au | Pt | Pd | Au |
| FRESH FEED | 200.00 | 100.00 | 0.21 | 0.19 | 0.04 | 100.00 | 100.00 | 100.00 |
| FINAL CONC | 24.73 | 12.37 | 1.22 | 1.19 | 0.19 | 71.77 | 78.07 | 60.33 |
| FINAL TAILS | 175.27 | 87.63 | 0.07 | 0.05 | 0.02 | 28.23 | 21.93 | 39.67 |

TABLE 11

(No recycle, pilot data)

| Flotation | Weight | Weight | Assay (g/T) | | | Recovery (%) | | |
|---|---|---|---|---|---|---|---|---|
| Product | (Kg/h) | (%) | Pt | Pd | Au | Pt | Pd | Au |
| FRESH FEED | 200.00 | 100.00 | 0.21 | 0.17 | 0.05 | 100.00 | 100.00 | 100.00 |
| CONC. 1 | 23.65 | 11.83 | 0.98 | 0.96 | 0.28 | 56.07 | 68.69 | 67.34 |
| CONC. 2 | 27.90 | 13.95 | 0.28 | 0.19 | 0.04 | 18.66 | 16.04 | 10.00 |
| FINAL CONC | 51.55 | 25.78 | 0.60 | 0.54 | 0.15 | 74.73 | 84.73 | 77.35 |
| FINAL TAILS | 148.45 | 74.22 | 0.07 | 0.03 | 0.01 | 25.27 | 15.27 | 22.65 |

TABLE 12

(No recycle, plant data)

| Flotation | Weight | Weight | Assay (g/T) | | | Recovery (%) | | |
|---|---|---|---|---|---|---|---|---|
| Product | MTon/h | (%) | Pt | Pd | Au | Pt | Pd | Au |
| FRESH FEED | 50.00 | 100.00 | 0.29 | 0.20 | 0.04 | 100.00 | 100.00 | 100.00 |
| CONC. 1 | 5.09 | 10.18 | 1.18 | 1.01 | 0.13 | 40.77 | 52.08 | 35.22 |
| CONC. 2 | 3.73 | 7.46 | 0.48 | 0.33 | 0.08 | 12.15 | 12.47 | 15.89 |
| CONC. 3 | 4.74 | 9.48 | 0.31 | 0.20 | 0.04 | 9.97 | 9.60 | 10.09 |
| FINAL CONC | 13.56 | 27.12 | 0.68 | 0.54 | 0.08 | 62.90 | 74.16 | 61.20 |
| FINAL TAILS | 36.44 | 72.88 | 0.15 | 0.07 | 0.02 | 37.10 | 25.84 | 38.80 |

TABLE 13

(Recycle according to the current invention, plant data)

| Flotation | Weight | Weight | Assay (g/T) | | | Recovery (%) | | |
|---|---|---|---|---|---|---|---|---|
| Product | MTon/h | (%) | Pt | Pd | Au | Pt | Pd | Au |
| FRESH FEED | 50.00 | 100.00 | 0.29 | 0.20 | 0.04 | 100.00 | 100.00 | 100.00 |
| FINAL CONC | 6.67 | 13.35 | 1.17 | 1.11 | 0.18 | 53.76 | 72.45 | 60.63 |
| FINAL TAILS | 43.33 | 86.65 | 0.16 | 0.07 | 0.02 | 46.24 | 27.55 | 39.37 |

The precious metal data presented in the tables above were obtained using the magnetics fraction only. The precious metal content of the non-magnetics fraction is relatively high. The flotation behaviour of precious metals in the combined streams of the magnetics and non-magnetics, obtained with the application of the present invention, is summarized below in Table 14. These data are essentially an extension of Table 9 previously examined in Example 3 for the separation of pyrrhotite from pentlandite and chalcopyrite.

TABLE 14

(Recycle according to the current invention)

| Flotation | Weight | Weight | Assay (g/T) | | | Recovery (%) | | |
|---|---|---|---|---|---|---|---|---|
| Product | MTon/h | (%) | Pt | Pd | Au | Pt | Pd | Au |
| FRESH FEED | 44.78 | 100.00 | 0.36 | 0.36 | 0.14 | 100.00 | 100.00 | 100.00 |
| FINAL CONC | 7.67 | 17.13 | 1.53 | 1.69 | 0.72 | 72.49 | 79.51 | 85.62 |
| FINAL TAILS | 37.11 | 82.87 | 0.12 | 0.09 | 0.03 | 27.51 | 20.49 | 14.38 |

As is notable from Tables 10, 13 and 14, the present invention provides significantly higher grades of precious metals. For example, the platinum grade increases from the range of 0.60–0.68 g/T to 1.17–1.53 g/T. Although the relatively higher feed grade in one particular case (Table 14) contributed to the recovery of higher grades of Pt (1.53 g/T) and Pd (1.69 g/T) in the concentrate obtained, it is clear that the present invention enables a superior grade-recovery performance for the precious metals.

EXAMPLE 5

In this example, the impact of the invention on the concentrate upgrading through a cleaning stage is examined. The magnetics flotation circuit of the plant were operated according to the present invention, essentially as shown in FIG. 2 which includes a cleaning stage and mechanical cell scavengers treating the cleaner tails. A 250 kg/h stream of concentrate was conditioned in the presence of a specific reagent as pyrrhotite depressant, for instance as described in the published Canadian Patent Application No. 2,082,831, before being sent to a pilot size column cell or Jameson cell. At the time of these tests the operating conditions and the metallurgical output of the magnetics flotation circuit were similar to those already examined in Table 5. Head grade to the cleaning stage was in the range 3.0–3.5% Ni, 0.9–1.4% Cu and 34.0–35.0% S. The following Table 15 shows the results obtained using the column cell as the concentrate cleaner.

TABLE 15

(Use of the column cell as a cleaner in concentrate upgrading)

| Flotation | Weight | Assay (%) | | | | | | Recovry (%) | | | | Po/Pn | Ni as |
|---|---|---|---|---|---|---|---|---|---|---|---|---|---|
| Product | (Kg/hr) | Ni | Cu | S | Pn | Cp | Po | Ni | Pn | Cp | Po | Ratio | NiBS |
| Fresh Feed | 250.00 | 3.44 | 1.36 | 34.49 | 8.13 | 3.95 | 76.43 | 100.0 | 100.0 | 100.0 | 100.0 | 9.40 | 4.07 |
| Column FEED | 514.68 | 4.26 | 1.44 | 32.80 | 10.51 | 4.18 | 69.99 | 100.0 | 100.0 | 100.0 | 100.0 | 6.66 | 5.29 |
| Column CONC. | 53.10 | 10.88 | 6.01 | 35.20 | 29.16 | 17.43 | 48.90 | 26.37 | 28.62 | 43.01 | 7.21 | 1.68 | 13.52 |
| Column TAIL | 461.58 | 3.50 | 0.92 | 32.52 | 8.37 | 2.66 | 72.41 | 73.63 | 71.38 | 56.99 | 92.79 | 8.65 | 4.33 |
| Scav Bnk FEED | 461.58 | 3.50 | 0.92 | 32.52 | 8.37 | 2.66 | 72.41 | 100.0 | 100.0 | 100.0 | 100.0 | 8.65 | 4.33 |
| Scav Bnk CONC | 264.68 | 5.03 | 1.52 | 31.19 | 12.76 | 4.40 | 63.90 | 82.56 | 87.44 | 94.89 | 50.60 | 5.01 | 6.57 |
| Scav Bnk TAILS | 196.90 | 1.43 | 0.11 | 34.30 | 2.46 | 0.32 | 83.85 | 17.44 | 12.56 | 5.11 | 49.40 | 34.03 | 1.66 |
| Cleaner CONC | 53.10 | 10.88 | 6.01 | 35.20 | 29.16 | 17.43 | 48.90 | 67.25 | 76.14 | 93.65 | 13.59 | 1.68 | 13.52 |
| Cleaner TAILS | 196.90 | 1.43 | 0.11 | 34.30 | 2.46 | 0.32 | 83.85 | 32.75 | 23.86 | 6.35 | 86.41 | 34.03 | 1.66 |

Corresponding results obtained with the application of the Jameson cell in place of the column cell in FIG. 2 are given in the following Table 16.

TABLE 16

(Use of the Jameson cell as a cleaner in concentrate upgrading)

| Flotation | Weight | Assay (%) | | | | | | Recovry (%) | | | | Po/Pn | Ni as |
|---|---|---|---|---|---|---|---|---|---|---|---|---|---|
| Product | (Kg/hr) | Ni | Cu | S | Pn | Cp | Po | Ni | Pn | Cp | Po | Ratio | NiBS |
| Fresh Feed | 250.00 | 3.00 | 0.90 | 34.51 | 6.85 | 2.58 | 78.73 | 100.0 | 100.0 | 100.0 | 100.0 | 11.50 | 3.49 |
| Jms Cell FEED | 288.96 | 3.29 | 1.00 | 34.26 | 7.72 | 2.90 | 77.10 | 100.0 | 100.0 | 100.0 | 100.0 | 9.99 | 3.88 |
| Jms Cell CONC | 53.15 | 9.50 | 3.60 | 33.64 | 25.26 | 10.43 | 54.37 | 53.11 | 60.18 | 66.14 | 12.97 | 2.15 | 12.06 |
| Jms Cell TAIL | 235.81 | 1.89 | 0.42 | 34.39 | 3.77 | 1.20 | 82.23 | 46.89 | 39.82 | 33.86 | 87.03 | 21.83 | 2.20 |
| Scav Bnk FEED | 235.81 | 1.89 | 0.42 | 34.39 | 3.77 | 1.20 | 82.23 | 100.0 | 100.0 | 100.0 | 100.0 | 21.83 | 2.20 |
| Scav Bnk CONC | 38.96 | 5.25 | 1.70 | 32.65 | 13.32 | 4.93 | 66.63 | 45.88 | 58.40 | 67.65 | 13.39 | 5.00 | 6.57 |
| Scav Bnk TAILS | 196.85 | 1.23 | 0.16 | 34.74 | 1.88 | 0.47 | 85.31 | 54.12 | 41.60 | 32.35 | 86.61 | 45.45 | 1.41 |
| Cleaner CONC | 53.15 | 9.50 | 3.60 | 33.64 | 25.26 | 10.43 | 54.37 | 67.67 | 78.42 | 85.79 | 14.68 | 2.15 | 12.06 |
| Cleaner TAILS | 196.85 | 1.23 | 0.16 | 34.74 | 1.88 | 0.47 | 85.31 | 32.33 | 21.58 | 14.21 | 85.32 | 45.45 | 1.41 |

It can be seen that the performance of these two devices as concentrate cleaner is equally good. Concentrate nickel grades of 9.5 to 10.9% Ni are obtainable at relatively high pentlandite recoveries in the 76–78% range. Thus, the data of this example demonstrates that the concentrate obtained according to the present invention is amenable to an excellent upgrading with specific reagents. As may be noted from previous examples, a typical weight recovery of the concentrate obtained in accordance with the invention is 12–15%. Because only this fraction of the new feed, rather than the whole, will require reagentizing for further upgrading, the present invention also proves itself valuable in minimizing the amount (hence the total cost) of any specific reagent that may be used.

In view of the examples provided above, it will be recognized that the advantages of the present invention have been demonstrated on a pilot scale as well as plant scale using difficult-to-treat process middlings with their pyrrhotite content ranging from about 60 to 80%. Inspection of the data presented in the tables of specific examples indicated that, in each case, flotation of pyrrhotite is greatly inhibited. Therefore, effecting the flotation, according to the present invention, represents an important development in the art of complex sulphide processing, and is highly effective in enhancing the separation efficiency of pyrrhotite from associated base metal sulphides containing non-ferrous metals as well as precious metals, thus improving the grade of concentrates, while minimizing or entirely eliminating the use of a specific depressant reagent in pyrrhotite rejection. It should be noted in this regard, that in the basic flotation circuit (without the cleaning stage) no specific reagent is required in accordance with the invention for depressing pyrrhotite. However, minor additions of a specific reagent should not be considered as circumventing the present invention. The novel process can be modified in a manner obvious to those skilled in the art without departing from the spirit of the invention and the scope of the following claims.

We claim:

1. A process for concentrating sulphide minerals or middlings containing non-ferrous metal values in association with pyrrhotite, which comprises:

(a) grinding the sulphide minerals or middlings at a pH above 9.5 into a fine pulp by means of grinding media such as to produce a low REDOX potential in the resulting pulp, said REDOX potential being less than a predetermined value selected within a range of −150 to −250 mV (SCE);

(b) subjecting said pulp having the REDOX potential of less than the predetermined value to a plurality of stages of froth flotation in the presence of a collector and a frother, but essentially in the absence of a specific pyrrhotite depressive reagent, whereby a concentrate is produced in each of the stages of the froth flotation during which the REDOX potential rises above the predetermined value in some stage or stages of said flotation;

(c) recycling the concentrate from the stage or stages where the REDOX potential has risen above the predetermined value back to the grinding step (a) and/or to a stage or stages where the REDOX potential is less than the predetermined value; and (d) collecting the concentrate from the stage or stages in which the REDOX potential is less than the predetermined value.

2. Process according to claim 1, in which grinding is carried out under reducing conditions in an alkaline pulp.

3. Process according to claim 2, in which the alkaline pulp has a pH of between 9.5 and 11.5.

4. Process according to claim 3, in which lime is used as the pH regulator.

5. Process according to claim 1, in which grinding is carried out with a grinding media comprising reactive iron.

6. Process according to claim 5, in which the grinding media is formed of mild steel.

7. Process according to claims 1, in which grinding is carried out in the presence of air.

8. Process according to claims 1, in which grinding is carried out so as to produce pulp which is at least 75% finer than 44 μm.

9. Process according to claim 8, in which said pulp is in excess of 85% finer than 44 μm.

10. Process according to claim 1, in which grinding is carried out so as to produce a REDOX potential below −250 mV (SCE).

11. Process according to claim 10, in which said REDOX potential is between −250 mV and −450 mV (SCE).

12. Process according to claims 1, in which the froth flotation is carried out with air sparging.

13. Process according to claims 1, in which the collector is a xanthate collector.

14. Process according to claim 13, in which the xanthate collector is selected from the group consisting of propyl, butyl and amyl xanthate.

15. Process according to claims 14, in which the collector is added in an amount sufficient to support the flotation of non-ferrous metal-containing minerals, but insufficient to trigger undesirable amount of pyrrhotite flotation.

16. Process according to claim 15, in which a starvation amount of the collector is used.

17. Process according to claim 1, in which the concentrate from the stage or stages where the REDOX potential is above the predetermined value is recycled to the grinding step carried out in a grinding mill charged with mild steel grinding media in an open circuit arrangement wherein said concentrate is subjected to a single regrinding pass.

18. Process according to claims 1, in which the concentrate from the stage or stages where the REDOX potential is above the predetermined value is recycled to a grinding step carried out in a grinding mill charged with mild steel grinding media in a closed circuit arrangement, with a classification circuit, wherein said concentrate is subjected to a cyclical regrinding pass.

19. Process according to claim 1, in which the concentrate collected from the stage or stages where the REDOX potential is less than the predetermined value is the final concentrate.

20. Process according to claim 1, in which the concentrate collected from the stage or stages where the REDOX potential is less than the predetermined value is further upgraded by subjecting it to a cleaning stage flotation.

21. Process according to claim 20, in which said cleaning stage flotation is carried out in the presence of a specific reagent for pyrrhotite depression.

22. Process according to claim 1, in which the sulphide minerals or middlings used as feed to the grinding step comprise pentlandite and where the amount of pyrrhotite is substantially at a maximum with reference to the pentlandite.

23. Process according to claim 22, in which the pyrrhotite to pentlandite ratio is greater than 40 in said feed.

24. Process according to claim 1, in which the middlings used as feed to the grinding step have a pyrrhotite contents from about 60% to 80%.

25. Process according to claim 1, in which the sulphide minerals or middlings comprise metal values selected from the group consisting of nickel, copper, cobalt, zinc, lead, platinum, palladium, gold and a combination thereof.

* * * * *